US005143598A

United States Patent [19]

Graham et al.

[11] Patent Number: 5,143,598

[45] Date of Patent: Sep. 1, 1992

[54] METHODS OF TAR SAND BITUMEN RECOVERY

[75] Inventors: Robert J. Graham; John J. Helstrom, both of Naperville, Ill.; Lawrence B. Peck, Houston, Tex.; Richard A. Stone, Yorkville; Edward J. Bernier, Jr., Naperville, both of Ill.

[73] Assignee: Amoco Corporation, Chicago, Ill.

[21] Appl. No.: 144,248

[22] Filed: Jan. 14, 1988

Related U.S. Application Data

[63] Continuation-in-part of Ser. No. 546,828, Oct. 31, 1985, Pat. No. 4,722,782.

[51] Int. Cl.[5] ..... C10G 1/04

[52] U.S. Cl. ..... 208/390; 208/391

[58] Field of Search ..... 208/390

[56] References Cited

U.S. PATENT DOCUMENTS

| | | | |
|---|---|---|---|
| 4,160,718 | 7/1979 | Rendall | 208/390 |
| 4,423,323 | 4/1984 | Horikoshi et al. | 208/390 |
| 4,424,112 | 1/1984 | Randall | 208/390 |
| 4,427,528 | 11/1984 | Lindorfer et al. | 208/390 |
| 4,460,452 | 7/1984 | Johnson et al. | 208/390 |
| 4,722,782 | 2/1988 | Graham et al. | 208/390 |

*Primary Examiner*—Asok Pal

*Attorney, Agent, or Firm*—Nick C. Kottis; William H. Magidson; Robert J. Wagner

[57] ABSTRACT

Methods for the recovery of bitumen from tar sands comprising the steps of mixing tar sand, solvent and a displacing amount of aqueous medium to form a mixture, followed by separating a bitumen-rich solvent phase from the mixture and recovering bitumen from the bitumen-rich solvent phase are disclosed.

35 Claims, 2 Drawing Sheets

% RECOVERY OF BITUMEN
MIXING POWER, HP/1000 GALLONS
0
20
40
60
80
100
1 MINUTE
5 MINUTES
10 MINUTES
20 MINUTES
30 MINUTES

% RECOVERY OF BITUMEN
WATER LEVEL, WT WATER/WT TAR SAND
0
20
40
60
80
100
0.1
0.2
0.3
0.4
0.5
5 MINUTES
10 MINUTES
20 MINUTES
30 MINUTES

METHODS OF TAR SAND BITUMEN RECOVERY

CROSS-REFERENCE TO RELATED APPLICATION

This application is a continuation-in-part of Ser. No. 546,828, filed on Oct. 31, 1983, now U.S. Pat. No. 4,722,782.

BACKGROUND OF THE INVENTION

This invention relates generally to the recovery of bitumen from tar sands and, more specifically, this invention relates to a water displacement extraction process for tar sand bitumen recovery.

Tar sands, also commonly referred to as oil sands or bitumen sands, are generally characterized as comprising a porous mineral structure, e.g., sandstone, which contains a high proportion of bitumen, i.e., a three component system of oils, resins and asphaltenes. While tar sand deposits are known to exist in various parts of the world, these deposits vary considerably in composition and property. Some tar sand deposits are relatively soft and free flowing while others are very hard or rock-like. Also, the tar or bitumen content of tar sand deposits may vary over a wide range.

Tar sands are frequently characterized by their mineralogy, such as by the liquid medium which is in contact with the mineral particles of the tar sand. For example, "water wet tar sands", such as the tar sand deposits generally found in the Athabasca deposit of Canada, comprise mineral particles surrounded by an envelope of water, sometimes referred to as connate water. Generally, the bitumen of such water wet tar sands is not in direct physical contact with the mineral particles but rather forms a relatively thin film which surrounds the water envelope around the mineral particles.

Alternatively, some tar sand deposits are characterized as "oil wet tar sands." While oil wet tar sands may, and generally do, include some minor amounts of water, such tar sand deposits generally do not include a water envelope barrier between the bitumen and the mineral particles thereof but rather comprise bitumen in direct physical contact with the mineral component of tar sand.

In addition, tar sands are frequently characterized by their richness or the amount of bitumen they contain and the quality thereof. For example, common parameters used to characterized bitumen quality include the boiling range of the bitumen; sulfur, nitrogen, oxygen and trace metal content; aromaticity and ease of hydrotreatment. In addition, tar sand deposits can be characterized by the presence or absence of naturally occurring surfactants.

The largest known tar sand deposit in North America is in the Athabasca region of Alberta, Canada and, as discussed above, primarily comprises unconsolidated, water wet tar sand. Smaller tar sand deposits are known to exist in the United States and in particular in the western United States. One of the largest minable tar sand deposits in the United States is referred to as the Sunnyside deposit and is located about 120 miles southeast of Salt Lake City in the mountains of Carbon County, Utah. The Sunnyside deposit comprises primarily partially consolidated, oil wet tar sand with minable reserves estimated at 1 to 2 billion barrels of bitumen, enough to provide up to about 100,000 barrels/day of syncrude for about 40 years. Consequently, such tar sand deposits could in the future serve as a secure domestic supply of hydrocarbons.

With respect to the Sunnyside deposit, it is believed that an ancient lake river delta system deposited porous beds of sand interlaced with non-porous beds of shale, called interburden. A heavy oil, known as bitumen, flowed into the porous sand beds at a later time from an unknown source to produce tar zones. Generally, bitumen is present at a level of about 4 to 13 weight percent of the tar sands in these porous sand beds. The Sunnyside deposit is further characterized in that the bitumen thereof is a low gravity, tar-like hydrocarbon having low sulfur and nitrogen concentrations with only about 25 wt. % of the bitumen having a boiling point of less than 1000° F.

In addition, the sandstone/mineral of the Sunnyside deposit is partially consolidated with carbonate minerals, e.g., mineral grains are held together by carbonate minerals. Thus, conventional oil recovery techniques such as steam flooding have generally proven unsuccessful when applied to such resources. Consequently, the common techniques for the recovery of hydrocarbons from such tar sands require that the tar sands be mined and processed. However, the small mineral particle size and the high viscosity of the tar-like bitumen makes recovery of bitumen from Sunnyside-like tar sands difficult as the bitumen is generally not readily separable from the mineral.

In the past, various methods have been proposed for the recovery of bitumen from tar sands but none of these methods have been entirely successful, particularly for the recovery of bitumen from oil wet tar sand deposits.

For example, a hot water process, also generally referred to as water flotation, has to a limited degree been successfully practiced as a processing technique for the water wet tar sands of the Athabasca deposit. Typically, such hot water processes utilize the film of water, e.g. connate water, which is found between the mineral and the bitumen to facilitate separation. For example, in one such hot water process, steam and hot water are commonly jetted through ground tar sand to form a slurry, with the mineral particles separating from the bitumen and water. When this slurry is allowed to stand, the mineral particles will tend to settle to the bottom of the vessel, and a large portion of the bitumen will float on the water. A significant portion of the bitumen will, however, remain in a middling layer composed of a froth of bitumen, water, air and light mineral particles from which separation of the bitumen is difficult. This method also suffers as it requires relatively large volumes of water to effect the separation of bitumen from the mineral matter. Further, the process has not proven to be practical for the recovery of bitumen from tar sands which lack the thin film of water surrounding the mineral particles, such as tar sand deposits found in the Western United States.

Other methods for the recovery of bitumen from tar sands have been developed which utilize solvent extraction. These methods generally suffer from the disadvantage of necessitating the difficult separation of mineral particles from the solvent extract phase. Still other methods use multisolvent systems wherein the tar sand is subjected to a series of solvents before it is finally recovered, which also exhibit a mineral separation problem.

Some methods have combined solvent and water processing of tar sands. For example, Alquist et al., U.S. Pat. No. 4,229,281 (Oct. 21, 1980) "Process for Extracting Bitumen from Tar Sands," discloses a method for the removal of sand fines generated during the solvent extraction of bitumen from tar sands. In this method a solvent solution of bitumen which has been separated from the mineral is contacted with an aqueous solution of cationic surfactant to effect the removal of sand fines from the solution.

Lowman, Jr. et al., U.S. Pat. No. 2,871,180 (Jan. 27, 1959) "Recovery of Oil from Tar Sands," discloses introducing an aqueous pulp of bituminous sand and a low molecular weight paraffinic solvent in a countercurrent fashion in a vertical extraction zone. During the countercurrent movement of the aqueous pulp and the solvent, a deasphalted oil and solvent phase, an asphaltene phase diluted with a lesser portion of the solvent, a water phase and a substantially oil-free sand are formed. The several phases and sand are then separated and further processed. It is disclosed that it is essential that the sand be initially thoroughly water wet to forestall subsequent oil wetting of the sand particles during solvent extraction. Further, the addition of larger quantities of water is disclosed as useful to break emulsions.

Rosenbloom, U.S. Pat. No. 3,875,046 (Apr. 1, 1975) "Recovery of Oil from Tar Sand by an Improved Extraction Process," discloses a process wherein tar sand and a liquid extraction stream are introduced to a single-stage extraction vessel in a countercurrent fashion. An oil phase and a water phase are separated in the extraction vessel with a water stream from the water phase being recycled to the extraction vessel. The initial mixing of the tar sands must be sufficiently gentle to avoid displacement of the tar sand fines.

Peterson et al, U.S. Pat. No. 4,110,194 (Aug. 29, 1978) "Process and Apparatus for Extracting Bituminous Oil from Tar Sands," discloses a method for recovering bituminous oil from tar sands comprising intimately mixing tar sands with a hydrocarbon solvent and continuing the mixing to produce a slurry of solid particles suspended in a solution of bituminous oil dissolved in the solvent. The slurry is then fed into a body of water, beneath the surface thereof, and the slurry is allowed to settle. Water-wet solid particles are removed from the bottom of the body of the water and a solution of hydrocarbon solvent and dissolved bituminous oil is removed from the surface of the body of the water. The dissolved bituminous oil is then recovered from the hydrocarbon solvent.

Gagon, U.S. Pat. No. 4,342,639 (Aug. 3, 1982) "Process to Separate Bituminous Material from Sand (Tar Sands)," discloses a method of extracting bitumen from tar sand utilizing a halogenated organic solvent having a density greater than water wherein the specified solvent containing mineral and dissolved bitumen is continuously transferred via a conveyor system partially submerged in water. As the material moves through the water on the conveyor, the organic solvent containing the bitumen separates from the mineral and forms a separate phase beneath the water. The mineral is ultimately moved upward on the conveyor for removal from the water.

European Patent Application 81305751.0, "Process and Apparatus for Extracting Bitumen Oil from Bitumen Containing Material," Rendall, published Jun. 15, 1983, discloses forming a slurry of solvent, tar sand and hot water while excluding substantially all air therefrom. The exclusion of air is disclosed as serving to greatly reduce the formation of emulsions of fine particles, water, bitumen and air. The treatment of oil wet tar sands is disclosed as necessitating the soaking of the ore in solvent prior to slurry formation with hot water. For the treatment of water wet tar sands, the need for solvent addition is disclosed as limited to the establishment of the preferred specific gravity desired for bitumen extract separation. By sparging the formed slurry with steam, the slurry is then separated into an upper bitumen extract phase, a middle water and sand phase and a lower damp sand phase. Each of these phases is thereafter processed to produce bitumen, recovered solvent, water, and spent sand.

Benson, U.S. Pat. No. 3,459,653 (Aug. 5, 1969) "Filtration of Solvent-Water Extracted Tar Sand," discloses a method for removing tar from tar sands comprising slurring tar sands and solvent in the presence of about 1 to 7 wt. % water (based on weight of tar sand), and then filtering the slurry through a bed of tar sands to produce a tar rich solvent filtrate. The water maintains an easily filtered slurry through control of sand fines.

Rendall, Great Britain Patent Document 1527269 "Solvent Extraction Process," discloses a solvent extraction process for the extraction of bitumen oils from tar sands, defined therein as the above-described water wet tar sands. In this process a tar sand and water slurry is formed and introduced through a specially designed contactor wherein solvent extraction occurs. The amount of water in the feed stream is determined by 1) the possible need to pump the tar sand/water slurry to the contactor, 2) the need for the tar sand/water stream to flow reasonably easily through the contactor and 3) the need to have the sand in the contactor adequately surrounded by water to prevent solvent from coming in contact with the sand except during the time interval when the sand is showered through the solvent. Accordingly, the amount of water should constitute at least 20 wt. %, advantageously over 40 wt. % and, preferably 50 wt. % of the tar sand/water stream on entry. Further, the presence of an enveloping volume of water with the sand is noted as serving the important function of forming a barrier separating the solvent from the sand and causing rapid displacement of any solvent retained on the sand.

Kelley, U.S. Pat. No. 2,980,600 (Apr. 18, 1961) "Process And Apparatus For Bituminous Sand Treatment," discloses a process and apparatus for treating tar sand with a warm basic aqueous solution of a special alkali metal silicate and a moderately heavy hydrocarbon diluent to separate the heavy oil from the bituminous sands. Freshly mined tar sand is mixed with diluent oil and the specified aqueous silicate solution at a temperature higher than about 160° F. and preferably maintained above 180° F. The effluent slurry from the mixture is discharged to a primary separation zone in which the treated solids are separated from the fluid. In the primary separation zone it is necessary to liberate oil drops from the sand stream. Such separation is effected via the agitation provided by means of a plurality of baffles contained in the zone. Further, to enhance the agitation and to ensure that the downwardly moving sand is sufficiently agitated to liberate trapped oil particles, a fluid stream, such as recirculated dilute aqueous silicate solution, is introduced to effect a net upward flow of the aqueous phase through the separator and to agitate the sand particles. The wet oil effluent and aqueous phases are discharged from the primary separator to the separation thickener wherein an interface between the oil emulsion and aqueous phases is formed. Wet oil is then discharged from the thickener to a settling zone wherein the wet oil phase is allowed to stand for a sufficient period of time, preferably a residence time of about twelve hours, to permit it to separate into dry oil and aqueous phases. In addition, water and diluent oil recovery and recirculation are disclosed.

Irani, et al., U.S. Pat. No. 4,036,732 (Jul. 19, 1977) "Tar Sands Extraction Process," discloses a tar sands extraction process for water wet tar sands wherein dry ground tar sand is contacted with water to form a slurry. The tar sand water slurry is then contacted countercurrently or in a single stage with a solvent forming three phases; a) a phase wherein a major amount of the bitumen present in the tar sand will be dissolved in a major portion of the solvent, b) a phase comprising the asphaltenes which are substantially insoluble in the solvent, and c) a phase comprising the sand along with a major portion of the added water and the water originally present in the tar sands, as well as minor amounts of bitumen and solvent. After separation from the other phases, the third phase comprising the sand along with the major portion of the water, as well as minor amounts of bitumen and solvent, may be further treated such as by contacting the sand with water.

Generally, the extent of bitumen recovery that is practically and economically obtainable by such methods which combine solvent and water treatment or conditioning of tar sand is limited due to the formation of difficult to break emulsions of water and bitumen-rich solution. Bitumen tied up in the form of an emulsion generally is not easily or economically recoverable, resulting in reduced bitumen recoveries and/or increased operating and capital cost.

SUMMARY OF THE INVENTION

It is an object of the invention to overcome one or more of the problems described above.

According to the invention, a method of recovery of bitumen from tar sands includes the step of mixing tar sands, an organic solvent and an aqueous medium at tar sands mixing conditions to suspend the tar sands in the mixture and to provide sufficient mass transfer between phases of the mixture without significant emulsion formation. Upon cessation of the mixing, the mixture is readily separable to a bitumen solution and a sand-water mixture. The organic solvent is effective in solubilizing bitumen including asphaltenes from the mineral of the tar sand. A displacing amount of no more than about one void volume of the aqueous medium is used. Further, the aqueous medium is effective in displacing bitumen-rich solvent from the tar sands and avoiding substantially spontaneous emulsion formation. A bitumen-rich solvent phase is separated from the mixture leaving an aqueous mineral phase containing a residual amount of the solvent. Subsequently, bitumen is recovered from the bitumen-rich solvent phase.

Other objects and advantages of the invention will be apparent to those skilled in the art from the following detailed description taken in conjunction with the drawings and the appended claims.

DETAILED DESCRIPTION OF THE INVENTION

According to the invention, a method of recovery of bitumen from tar sands is provided. The invention contemplates a method of tar sand bitumen recovery applicable to both water wet tar sands and oil wet tar sands and which tar sands may be unconsolidated or partially consolidated with mineral. It is to be understood, however, that in view of difficulties such as those identified above with respect to the recovery of bitumen from oil wet tar sands, that the process of the invention will likely find particular utility with respect to the recovery of bitumen from oil wet tar sands. Thus, while the invention will be described herein as it relates to the recovery of bitumen from oil wet tar sand deposits, and specifically partially consolidated oil wet tar sands such as from the Sunnyside deposit in Carbon County, Utah, the invention is understood to encompass the recovery of bitumen from unconsolidated oil wet tar sand deposits as well as water wet tar sand deposits (both unconsolidated and partially consolidated).

Figure 1:
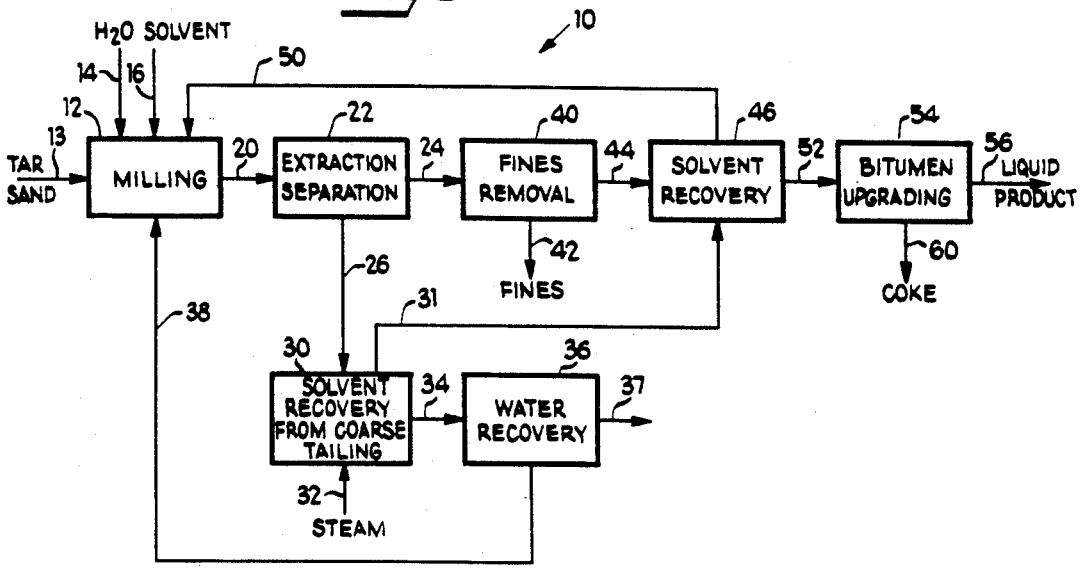
FIG. 1 is a simplified block diagram of a method of tar sand bitumen recovery according to a typical embodiment of the invention.

FIG. 1 illustrates a simplified block diagram, generally designated 10, of a method of bitumen recovery according to a typical embodiment of the invention.

Raw, partially consolidated tar sand is milled or ground in a suitable grinding device 12, such as an autogeneous, semi-autogeneous, caged, rod, or ball mill, for example, to a desired particle size. Generally, the raw tar sand is ground to a particle size no larger than about ½ inch in diameter to facilitate the material handling thereof and to increase the amount of bitumen recovered therefrom, such as by increasing the surface area thereof. Process economics, wherein the energy and equipment costs required to make smaller particles are balanced with the increased processing times generally necessary to effect bitumen recovery from larger particles, generally result in particles of about ⅛-⅜ inch in diameter being preferred.

It is to be understood, however, that for unconsolidated tar sands, milling or grinding will not generally be needed as such tar sands, in suitable particle sizes (i.e., no larger than about ½ inch in diameter), can generally be obtained through conventional mining techniques, for example, or with simple conditioning, e.g. heating, and screening to reject oversize particles.

While any suitable milling technique may be used, autogeneous and semi-autogeneous milling are believed to be preferred because they facilitate the implementation of wet grinding techniques, e.g., grinding done in the presence of a liquid such as solvent, water or a combination thereof. The limited number of moving parts and openings in autogeneous and semi-autogeneous mills result in such mills being particularly amenable to sealing to prevent liquid escape therefrom. For example, in grinding tar sands in the presence of solvent, it is important to minimize the amount of solvent loss for a number of reasons including 1) solvent is a comparatively expensive component, 2) solvent escape can result in environmental contamination and 3) solvent escape can create fire hazards.

A selection between autogeneous and semi-autogeneous milling will likely be impacted by the mining methods employed. For example, for a feed having a relatively small top size, e.g., mining which results in a maximum tar sand particle size of no larger than about four inches, semi-autogeneous milling will likely be preferred as the addition of impact objects will likely be needed for the tar sand to be ground to a desired particle size range. For a feed having a comparatively large top size, e.g., mining which results in tar sand particle size of about twelve inches, autogeneous milling will likely be preferred as such particles are generally sufficiently large to self generate a milling medium to provide the grinding of the tar sand to the desired size range.

Dry grinding of tar sands has been found to result in generally higher grinding power requirements and low throughput as tar buildup occurs on the mill lining during the grinding process. Thus, according to the invention, wet grinding techniques are generally preferred for use in the milling of tar sands as such grinding techniques can facilitate and reduce the cost associated with the grinding and preparation of tar sands as compared to dry grinding. For example, water wet grinding serves to reduce tar buildup on the mill lining as compared to dry grinding. The water can also serve as a medium with which the mill interior can be cleared in a continuous fashion. In solvent wet grinding, the solvent can act to reduce the cohesive forces that hold the mineral particles together and thus reduce the grinding energy requirements as compared to dry grinding. Solvent/water wet grinding (later described herein) is a particularly preferred wet grinding technique. In solvent/water wet grinding the above-identified advantages of water wet grinding and solvent wet grinding can be combined with the additional benefit of the use of solvent and water in the proper amounts for an efficient operation.

The embodiment illustrated in FIG. 1 will be described with reference to a process wherein solvent-/water wet grinding is utilized. It is to be understood, however, that the invention can be practiced utilizing other grinding techniques provided corresponding adjustments with respect to the addition of solvent, aqueous medium or both are made as described herein.

Accordingly, a feed stream 13 of raw tar sand, a water stream 14 and a solvent stream 16 are fed to the grinding device 12.

After milling, a milled product stream 20 is passed to an extraction-separation zone 22 wherein mixing between the ground tar sand, an organic solvent effective in solubilizing bitumen, including the asphaltene component thereof, from the mineral of the tar sands, and a displacing amount of no more than about one void volume of an aqueous medium effective in displacing bitumen-rich solvent from the ground tar sands with subsequent phase separation is effected to form a mixture.

In practice, whether solvent and/or aqueous medium need be added or removed in the extraction-separation zone 22 or prior thereto will largely be dependent on the grinding technique used to grind the raw tar sand. For example, when the raw tar sands have been ground using the technique of dry grinding, i.e., grinding in the absence of a liquid medium, the subsequent addition of both solvent and aqueous medium will be required. If the raw tar sands have been ground using the technique of solvent wet grinding, i.e., grinding in the presence of a liquid solvent, solvent will be present in the grinding device. Thus, subsequent addition of the aqueous medium alone will generally be required for the practice of the invention with solvent wet ground tar sand. If the tar sand has been prepared using the technique of water wet grinding, i.e., grinding in the presence of water, the ground tar sand slurry comprising the ground tar sand and aqueous medium will generally require dewatering as the product stream will contain an oversupply of water for subsequent processing which, in turn, can result in emulsion formation.

Combined solvent/water wet grinding, i.e., grinding in the presence of both solvent and water, is believed to be the preferred grinding technique in that the amount of water required in the grinding device 12 to facilitate grinding of the tar sand will generally be sufficiently reduced due to the presence of the solvent to eliminate the need for a subsequent downstream dewatering step as is generally required in processes using a water wet grinding technique of milling.

The addition of solvent to the tar sands serves to reduce the viscosity of the bitumen and to thereby facilitate the handling of the bitumen at reasonable temperatures. For example, the solvent may facilitate flow between the mineral grains of the tar sand and the formation of a bitumen-rich solvent phase, which can be pumped at near atmospheric pressure. In addition, solvents which readily separate from water serve to promote the ready separation of the aqueous mineral phase from the bitumen-rich solvent phase.

Solvents useful in the practice of the invention will generally be those organic compounds which are substantially insoluble in water and which dissolve substantially all the bitumen, including the asphaltene component thereof of the tar sand. The solvent can be unsubstituted or substituted by at least one halogen, oxygen, nitrogen or sulfur atom and has from 1 to 15 carbon atoms. Useful solvents include paraffinic hydrocarbons such as n-butane; methyl and dimethyl butane; n-pentane; n-hexane; n-heptane; n-octane; and methyl, ethyl, dimethyl, and trimethyl pentanes, hexanes, heptanes and octanes; cyclohexane; aromatic hydrocarbons such as benzene, toluene and the xylenes, methyl ethers; ethyl ethers; methyl ethyl ether; and halogenated derivatives of any of these; and mixtures of any of the aforementioned. Alternatively, if desired, a non-hydrocarbon solvent such as carbon tetrachloride, for example, may be used.

The selection of a proper solvent will be dependent upon the objectives which are sought to be achieved. Bitumen can generally be considered as a three component system of oils, resins, and asphaltenes, with oils being the lightest component and asphaltenes being the heaviest component. For increased hydrocarbon recovery it will be generally preferred to recover hydrocarbon from all three components of the bitumen, including the asphaltenes. Some solvents, such as pentane, n-heptane and other relatively low molecular weight straight chain hydrocarbons, are effective in solubilizing bitumen, including the asphaltene component thereof, once the lighter components of the bitumen, e.g., the oil and resin components have been sufficiently solubilized. It is believed that the presence of the oil and resin components in the solvent solution change the solubility parameter of the solution to more closely match that of the asphaltenes. Thus, once the level of bitumen in solution has reached the needed threshold, e.g., generally at least about 15 wt. % bitumen in solution, and preferably about 20–30 wt. % bitumen in solution for n-heptane or generally for solvents of similar viscosity and specific gravity, then such solvents also serve to solubilize the asphaltene component of the bitumen. The selection of a solvent which solubilizes the oil and resin components comparatively easily and the asphaltene component only after the solubilization of the oil and resin components will be particularly preferred when downstream processing includes, for example, fines removal by deasphaltening, as described later herein. Thus, solvent selection can impact on downstream processing and vice-versa.

Generally, solvents which are effective in solubilizing bitumen including asphaltenes, including those solvents which generally first require solubilization of the lighter components of the bitumen, and solvents which easily separate from the mineral component of the tar sand, e.g., lower the viscosity and the specific gravity of the bitumen-rich solvent phase relative to the mineral containing aqueous phase, will be preferred for the practice of the invention. As described above, the selection of a specific solvent for use will likely be dependent on the downstream processing to which the solvent will be subjected to and, because of generally lower overall cost, will preferably be a by-product of the process. Thus, in the commercial practice of the invention, a naphtha cut from a bitumen upgrading step will likely be a preferred solvent.

In general, the amount of solvent used, while dependent on a number of factors including the type of solvent and tar sand being treated, the particle size of the tar sand, the temperature of the mixture, etc., need only be sufficient to separate the bitumen from the tar sand mineral and thereby form an organic phase separable from the mineral component of the tar sand. Generally, the amount of solvent will range from about 2 to 5 parts of solvent per part of bitumen in the tar sands, particularly for paraffinic and naptha-like solvents. Lesser or greater amounts of solvent can be used with a corresponding diminishment of the effectiveness, economy of operation, or both for the process. For example, since in most commercial processes the solvent will be recycled, the use of solvent in amounts in excess of that required will increase the costs associated with solvent recovery and recycle. Also, the amount of solvent can be at least in part related to the amount of aqueous medium added and the effectiveness of the solvent utilized, e.g., different solvents more easily solubilize different components of the bitumen. For example, it has been found that the above-described solvents, such as pentane and n-heptane, which generally solubilize the asphaltene component of bitumen only after at least partial solubilization of the lighter components of the bitumen, are usually required to be present in at least an amount effective to solubilize the oil and resin components of the bitumen sufficiently so that the asphaltene component also solubilizes. Thus, such solvents must generally be present in a range of about 2–5 parts of solvent per part of bitumen, and preferably about 3–4 parts per part of bitumen, as the presence of too much or too little of such solvents results in not all of the bitumen dissolving. In contrast, solvents such as aromatic and high molecular weight straight hydrocarbon chain solvents are relatively effective in solubilizing all components of the bitumen and can be used in a broader range of concentration.

The displacing amount of the aqueous medium includes the amount of water present initially in the tar sands, which for oil wet tar sands is generally below about 2 wt. % and typically below about 0.5 wt. %. Thus, aqueous medium is added in an amount sufficient to total (including the amount of water present in the untreated tar sand) about one void volume of displacing liquid. It being understood that "one void volume" is that amount generally sufficient to fill the void between the minerals of the tar sand after the tar sand has been milled and the bitumen dissolved therefrom and, in the case of tested Sunnyside tar sands samples, is generally in the range of about 0.22 to 0.27 pounds of water per pound of mineral.

It is to be understood, however, that the specific water to mineral ratio will be dependent on characteristics of the tar sand used, such as its mineral density, size and shape. For example, tar sands comprising particles having a comparatively broad size distribution will generally pack better, e.g., with less space or volume between particles, and therefore require less water relative to the mineral in the tar sand to fill the void between the minerals of the tar sand after the bitumen has been dissolved therefrom. Conversely, tar sands comprising particles having a comparatively narrow size distribution will generally pack poorer and therefore require more water relative to the mineral in the tar sand to fill the void therein. Also, tar sands comprising particles of the same general size (volume) and density but irregularly shaped will generally pack poorly and therefore have a larger void volume. Further, for tar sands comprising particles of a fixed size and shape, denser tar sand particles generally result in a reduction in the water to mineral ratio. Thus, in the practice of the invention, different sizes and shapes of tar sand particles will pack differently with richer tar sands generally requiring less aqueous medium to effect displacement. The addition of aqueous medium in an amount sufficient to total more than one void volume is generally to be avoided as such additional amounts of water may result in significant emulsion formation.

As used herein, significant emulsion formation generally constitutes greater than about 5–20 wt. % bitumen emulsified for one stage of extraction/separation and greater than about 5 wt. %, preferably greater than about 2 wt. % bitumen emulsified for the entire process system.

According to the invention, the aqueous medium advantageously does not require additives such as surfactants or bases to effect bitumen recovery. It is to be understood, however, that such additives may, if desired, be added. Of course, a need for such additives can increase the cost of the tar sand processing, such as through increasing the likelihood of emulsion formation or by requiring the removal therefrom from the product stream. Consequently, the invention will be further described with reference to an aqueous medium consisting essentially of water.

In the extraction/separation zone 22, tar sand, solvent and water are mixed to suspend the tar sand and to promote intimate contact between the solvent, bitumen, mineral and water whereby most of the mineral, and preferably substantially all the mineral, is transferred to the aqueous phase without significant emulsion formation.

At the above-identified water levels, the mixture is relatively stable for a relatively long period of time at a broad range of mixing intensity or input of mixing power. Thus, according to the invention, the mixture of tar sand, solvent and water, while generally requiring a mixing power input of at least one horsepower per 1,000 gallons of tar sand, solvent and water mixture, is tolerant to a broad range of mixing power inputs, e.g., about 1–50 horsepower/1,000 gallons of the tar sand, solvent and aqueous medium mixture and preferably about 20–30 horsepower per 1,000 gallons of tar sand, solvent(n-heptane) and water mixture. (Hereinafter, all mixing power input references to horsepower are to be understood to be in reference to 1,000 gallons of the particular tar sand, solvent and aqueous medium mixture.)

Mixing power inputs of greater than about 50 horsepower per 1,000 gallons have been found to be conducive to emulsion formation and therefore result in reduced bitumen recovery. Further, dependent upon the specific process configuration, lower power inputs are believed to be effective. For example, when the tar sand has been dry ground, followed by solvent extraction and water addition or solvent wet ground followed by water addition, a mixing power input of about 1 to 10 horsepower, and preferably 2–5 horsepower, is all that is generally needed.

The system formed upon such mixing easily stratifies upon cessation of the mixing as a result of the substantial difference in density between the bitumen solution and the mineral-water mixture, with the bitumen solution rising to the top and the mineral-water mixture settling to the bottom relatively rapidly as compared to conventional bitumen recovery processes.

Subsequent to the mixing in the extraction/separation zone 22, a bitumen-rich solvent phase 24 is separated from the mixture. Such separation is facilitated as the mixture formed according to the invention is readily separable to a bitumen solution and a mineral-water mixture upon cessation of the mixing. An artisan skilled in the art and guided by the teachings herein may select any effective separation technique for the phase separation of the bitumen-rich solvent phase 24 from the mixture. For example, such separation may be effected by centrifugation, hydrocyclones, gravity separation enhanced with the electrical fields, or as is believed to be preferable because of ease of operation and reduced capital and operating costs, by continuous gravity separation.

Also, such separation may be effected in a separate vessel from that used for the mixing of the components of the mixture or if preferred, the process may be designed so as to permit the separation step to occur in the same vessel as used for the mixing treatment.

The separation of the bitumen-rich solvent phase 24 from the mixture leaves an aqueous mineral phase 26 comprising the mineral component contained in an aqueous medium with a residual amount of the solvent.

Subsequently, both the bitumen-rich solvent phase and the aqueous mineral phase can be further treated. For example, the residual amount of solvent adsorbed to the mineral in the aqueous mineral phase 26 may be recovered via a zone 30 solvent recovery from coarse tailings. Such residual solvent, shown as a flow stream 31, is preferably recovered by stripping the aqueous mineral phase 26 with steam, represented as a stream 32, for example, in a rotary kiln or packed column. The stripping is preferably performed in a column packed with a suitable packing such as, for example, that used for the removal of $SO_2$ from a gas by countercurrent contact with a lime slurry. Typically, such steam stripping of the aqueous mineral phase is effected by feeding the aqueous mineral phase through the top of a packed column and injecting steam at the bottom of the column. The condensate taken off the top of the column will contain desorbed solvent and water, and is easily separated. A clean mineral and water slurry is taken from the column bottom. A mineral and water slurry stream 34 is fed to a water recovery zone 36. In the water recovery zone 36, the mineral tailings are separated from the water by suitable means, such as by filtration, centrifugation or allowing to set in a setting pond. In view of the earlier removal of the solvent from the mineral by the water displacement and stripping, such separation by filtration can be accomplished without requiring expensive solvent/tight covers to prevent the escape of solvent.

The mineral tailings product stream 37 is bitumen lean and, as shown, will generally be disposed of without further bitumen recovery processing.

Alternatively, the mineral tailings can be treated by another stage of water displacement (not shown) to desorb and float solvent from the mineral. For example, the aqueous mineral phase may be mixed with additional aqueous medium with the product from such mixing being sent to a thickener wherein the residual solvent floats to the top and is separated.

Water recovered in the water recovery zone 36 may preferably be recycled to the milling zone 12 such as by a water recycle line 38.

The bitumen-rich solvent phase 24 is then further processed for the recovery of bitumen. For example, the mineral fines content of the bitumen in the bitumen-rich solvent phase 24 can, as shown, be reduced such as by treatment in a fines removal zone 40.

For example, the deasphaltening method of mineral fines removal as described in Wolff et al. U.S. Pat. No. 4,596,651 (Jun. 24, 1986), the disclosure of which is incorporated herein by reference, can be used to effect removal of most fines. In this deasphaltening method, the bitumen-rich solvent phase 24, which phase contains fines, e.g. mineral matter particles so fine that they were not transferred to the aqueous phase separated from the solvent phase earlier in the process, is treated in the fines removal zone 40 wherein the bitumen-rich solvent is contacted with a solvent of limited solubility for asphaltenes. A portion of the asphaltene content of the bitumen precipitates and in so doing acts to agglomerate the fine mineral particles represented by the stream 42 to lower the fine content of the bitumen-rich solvent phase.

It is to be understood, however, that alternative methods of fines removal may, if desired, be utilized in the practice of the invention.

The mineral fines stream 42 may, if desired, be recovered for further processing such as heat recovery such as by processing the fines stream in a fluidized bed combustor (not shown) for example, or disposed of.

A comparatively fine-free bitumen-rich solvent phase 44 is then sent to a solvent recovery zone 46 wherein the solvent and bitumen are separated. One skilled in the art and guided by the teachings set forth herein can recover bitumen from the phase 44 by various techniques including, for example, evaporative drying. Recovered solvent, represented by the stream 50, and which preferably may include solvent recovered in zone 30 from the coarse tailings may, if desired, be recycled to the milling zone 12 to effect solvent/water wet grinding. For example, dryers may be used for the evaporation of the solvent component of the deasphaltened bitumen-rich solvent phase 44.

Upon isolation of the bitumen, in the solvent recovery zone 46, such bitumen, represented by a stream 52, can be fed to a bitumen upgrading zone 54 for further upgrading and processing as is known in the art. For example, the bitumen may be retorted in a conventional fashion to produce a liquid product stream 56 and a coke byproduct stream 60.

Practice of the invention generally leads to a recovery of more than 90 wt. % of the bitumen from the tar sand and preferably more than 95 wt. % of the bitumen from the tar sand.

Figure 2:
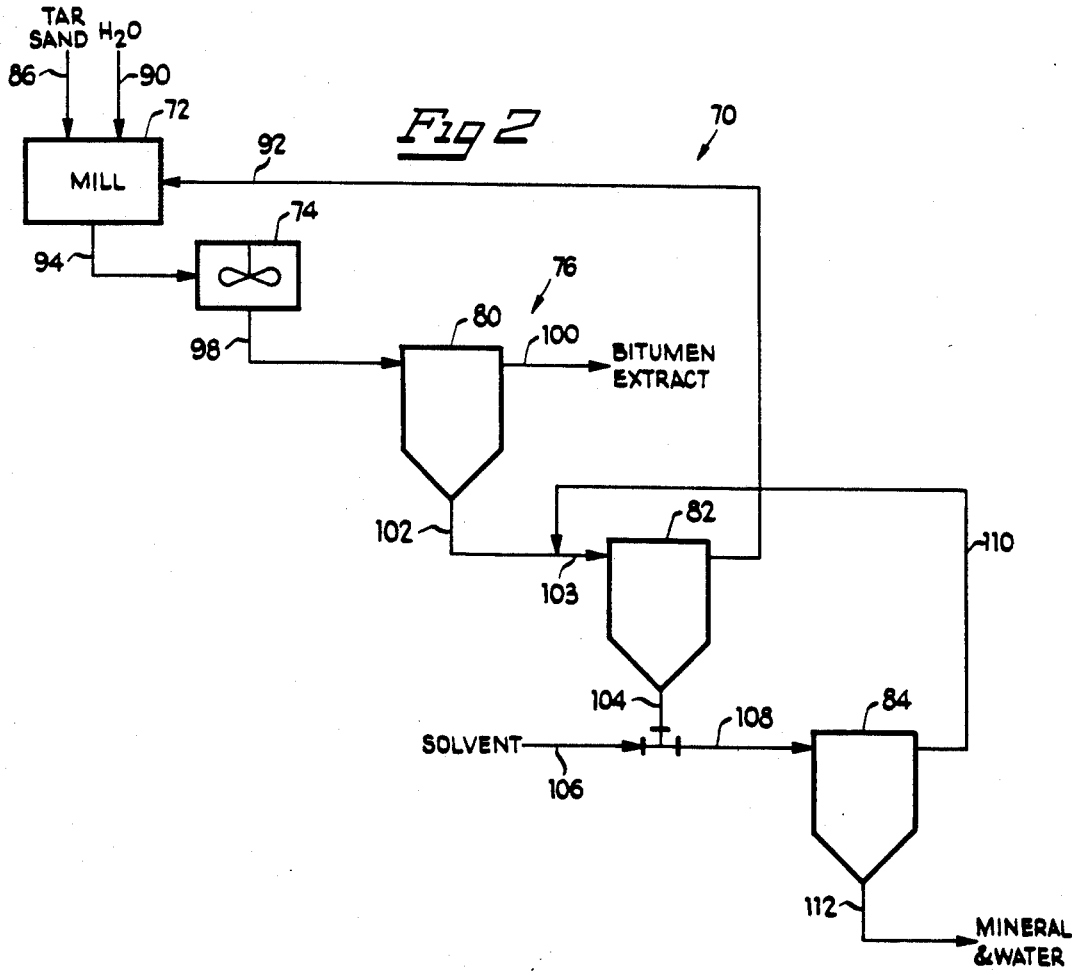
FIG. 2 is a schematic flow diagram of milling and extraction/separation of a method of tar sand bitumen recovery according to a preferred embodiment of the invention.

Referring now to FIG. 2, a preferred embodiment of the present invention is shown. A system, generally designated 70, includes a mill 72, a mixer 74, and a separator train 76 comprising separators 80, 82, and 84.

A tar sand feed stream 86 containing, for example, raw Sunnyside tar sand, is fed to the mill 72 along with water fed via a water flow stream 90. Also feeding into the mill 72 is a solvent recycle stream 92 (later described herein).

In the mill 72, the tar sand in the feed stream 86 is solvent/water wet ground to a desired particle size. A solvent/water/tar sand flow stream 94 exits the mill 72 and is passed to the mixer 74 wherein the ground tar sand, organic solvent and aqueous medium are mixed so as to suspend the tar sand in the mixture and to provide sufficient mass transfer between the phases of the mixture without significant emulsion formation.

Sunnyside tar sand contains bitumen which has been found to include naturally occurring surfactant(s) that changes form at pH levels greater than pHs of about 9 and acts to reduce the interfacial tension between the aqueous and organic phases whereby the phases may easily and spontaneously emulsify. Consequently, the pH level of the mixture of solvent, water and tar sand must be maintained at a level whereby the interfacial tension between the aqueous and organic phases is not reduced to a level promoting spontaneous emulsification.

A solvent/water/tar sand mix flow stream 98 exits the mixer 74 and is passed to the separator train 76, with the stream 98 being directly passed to the separator 80. In the separator train 76, wherein countercurrent purification principles are used, the mixture is readily separable to a bitumen solution and a sand-water mixture. Thus, bitumen is extracted in the separator 80 and is shown as a bitumen extract stream 100. The underflow from the separator 80 and shown as a stream 102, which stream contains mineral, water and comparatively minor amounts of bitumen and solvent, is combined with a recycle stream 110 (later described herein) to form a stream 103. The stream 103 is fed to the separator 82 wherein relatively pure solvent is withdrawn, as shown by a flow stream 92 and is recycled to the mill 72, as described above, to allow solvent/water wet grinding to occur. It is to be understood, however, that additional solvent (not shown) may be added to the mill 72 if needed or desired for the grinding operation. An underflow stream 104 from the separator 82 is combined with fresh solvent as shown by a solvent flow stream 106 to form a stream 108 which is fed to the separator 84. It is to be understood, however, that the fresh solvent and the underflow stream from separator 82 may each be separately fed directly to the separator 84, if desired.

An extract stream 110 from the separator 84 is fed to the separator 82 for further processing. If desired, the stream 110 may, as shown, be joined with the stream 102 to form a combined stream 103 to separator 82. An underflow stream 112 from the separator 84 is withdrawn and comprises primarily mineral material and water. Such a process configuration serves to decrease the concentration of bitumen in the underflow from successive separators and, is believed to have as a corollary effect, improving water wetting of the tar sand mineral.

It is to be understood that, while the invention has been shown and described with reference to the system 70 containing three stages of countercurrent separation, the invention can be practiced with greater or fewer stages of separation. For example, system or process economics may make it desirable to recover residual bitumen from the underflow from the third separator and therefore make it desirable to include an additional separator(s) to the separator train.

As described above, the underflow stream 112 may, if desired, be further processed for removal and recovery of the water from the mineral sand.

While the practice of the invention is believed to be relatively insensitive to the operating temperature of the process, e.g., operating temperature of mixers, settlers, etc., of about 70°–145° F. had been found effective, the process is believed to be more efficiently operated at temperatures elevated relative to room temperature, with operating temperatures of 110°–130° F. being preferred and an operating temperature of about 120° F. being especially preferred. The heat balance around the project is easier and cheaper at these elevated temperatures as heat is rejected at a higher temperature. Further, at these elevated temperatures, the viscosity of the solvent is reduced whereby better mixing may be achieved and the density differential between the solvent and water is increased whereby better separation may be obtained.

As used herein, tar sand mixing conditions include mixing intensity or power and mixing duration. As described above, the mixture of tar sand, solvent and water while generally requiring a power input of at least one horsepower per thousand gallons, is tolerant to a broad range of mixing power inputs, e.g., about 1–50 horsepower per thousand gallons and preferably about 20–30 horsepower per thousand gallons of mixture with n-heptane as solvent. Mixing durations of greater than one minute are generally required regardless of the mixing power in order to effect practical recoveries of bitumen.

The following examples illustrate the practice of the present invention. It is to be understood that all changes and modifications that come within the spirit of the invention are desired to be protected and thus the invention is not to be construed as limited by these examples.

EXAMPLES

Slabs of partially consolidated, oil wet tar sand from the Saint Mary's tract in Sunnyside, Utah were fragmented into tar sand slab fragments, e.g., fragments having a top size of about one foot in diameter. The tar sand fragments were then fractionated and combined in a size distribution similar to that likely to be produced in a commercial mining process. The fragments were then dry ground to a particle size of about one-quarter inch top size in an autogeneous mill.

A simulated recycle solvent solution, generally comprising about 83–88 wt. % n-heptane as a solvent, 8.5–11 wt. % bitumen and 3.5–6.5 wt. % mineral, was added to the ground tar sand in a mixed tank at conditions of a residence time of about 20 minutes and a temperature of 120° F.

The specified amount of water was then added to the mixed tank containing the tar sand and simulated recycle solvent solution. The contents of the mixed tank were then mixed with the specified mixing power input and mixing duration.

Figure 3:
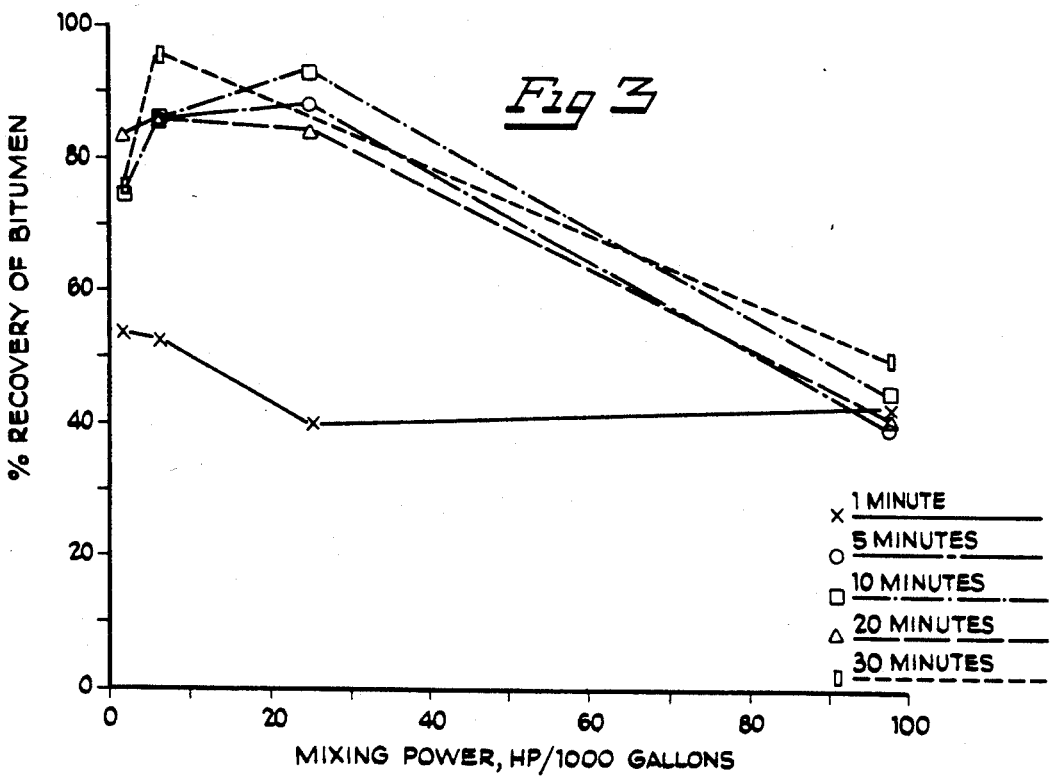
FIG. 3 is a graphical representation of percent recovery of bitumen versus mixing power for various mixing times at a water level of about 0.25 parts of water per part of tar sand.

FIG. 3 is a graphical representation of percent recovery of bitumen versus mixing power for various mixing times at a water level of about 0.25 parts of water per part of tar sand.

Figure 4:
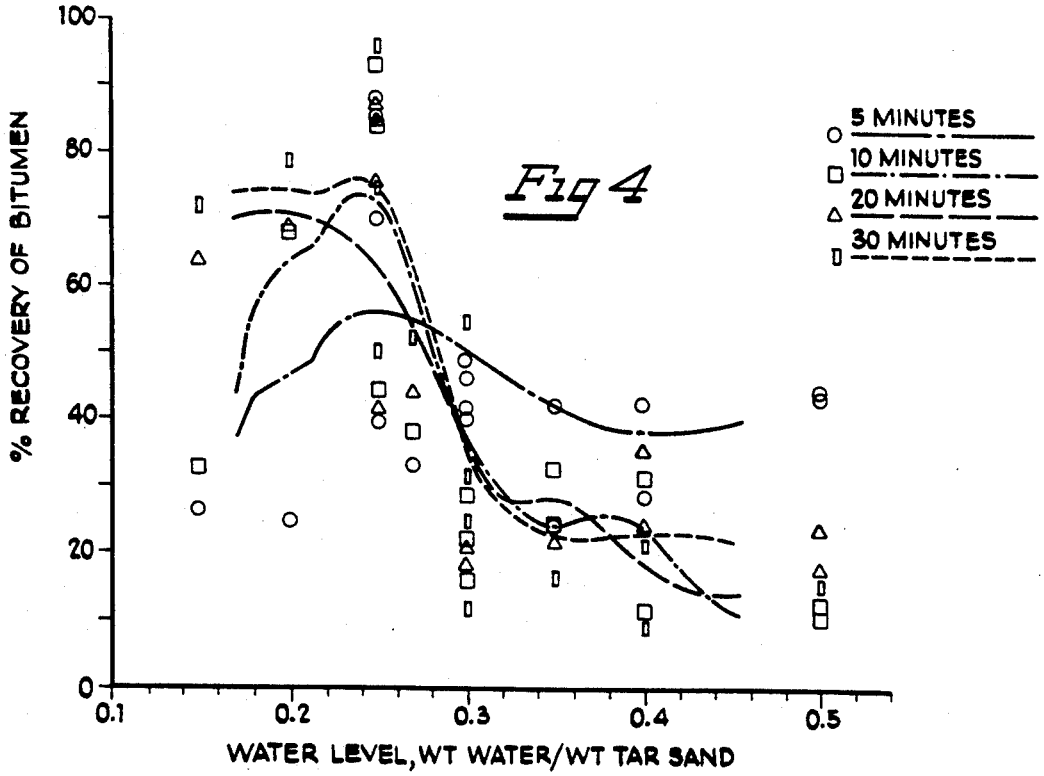
FIG. 4 is a graphical representation of percent recovery of bitumen versus water level for various mixing times with a mixing power of about 1-25 horsepower per 1,000 gallons of mixture.

FIG. 4 is a graphical representation of percent recovery of bitumen versus water level for various mixing times with mixing power or intensity of about 1–25 horsepower/1,000 gallons of mixture.

As shown in FIG. 3, one minute of mixing generally resulted in a bitumen recovery of about 40–55 percent for all mixing powers. [NOTE: The percent recovery of bitumen shown in FIGS. 3 and 4 are low compared to the percent recovery of bitumen by the method of the invention, as FIGS. 3 and 4 illustrate the percent recovery of bitumen for one stage of separation as opposed to a system, such as that shown and described with reference to FIG. 2 for example, having multiple stages of separation whereby percent bitumen recovered exceeding 90 wt. % and preferably 95 wt. % can be attained.] After five minutes or more of mixing, however, bitumen recovery was about 75–95 percent for mixing powers from 1 to 25 horsepower/1,000 gallons. Thus, a mixing time of at least more than one minute will generally be required to effect desired bitumen recoveries. A mixing power of about 100 horsepower/1,000 gallons generally resulted in the bitumen recovery remaining at the 40–50 percent range regardless of the mixing time. Such lower bitumen recoveries may be as a result of shear formed emulsions occurring at such high inputs of mixing power.

As shown in FIG. 4, an optimum in bitumen recovery occurred at a water level of between about 0.2–0.26 parts of water per part of tar sand. (This generally corresponds to the above-identified range of 0.22–0.27 pounds of water per pound of mineral.) As FIG. 4 illustrates there is a dramatic drop off in bitumen recovery as the water level is increased beyond this range. At water concentrations above this optimal level, the percent recovery of bitumen decreased. Such decrease in the percent recovery of bitumen is believed to be largely due to the formation of emulsions from which bitumen is not easily or practically recoverable. That these higher amounts of water can result in decreased bitumen recovery is not readily apparent as evidenced, for example, by Rendall, Great Britain Patent Document 1527269, which discloses that the amount of water should constitute at least 20 wt. %, advantageously over 40 wt. % and, preferably 50 wt. % of the tar sand-/water stream or parent application (U.S. Ser. No. 546,828) which discloses adding greater than about 0.50 pound of water per pound of tar sand.

The foregoing detailed description is given for clearness of understanding only, and no unnecessary limitation should be understood therefrom, as modifications within the scope of the invention will be obvious to those skilled in the art.

What is claimed is:

1. A method of recovery of bitumen from tar sands comprising the steps of:

mixing tar sands, an organic solvent effective in solubilizing bitumen including asphaltenes from the mineral of said tar sand and a displacing amount of no more than about one void volume of an aqueous medium effective in displacing bitumen-rich solvent from said ground tar sands and in avoiding substantially spontaneous emulsion formation to form a first mixture, said mixing being at tar sands mixing conditions including mixing intensity and duration to suspend said tar sand and provide sufficient mass transfer between phases of said first mixture without significant emulsion formation, said first mixture being readily separable to a bitumen solution and a sand-water mixture upon cessation of said mixing;

separating a bitumen-rich solvent phase from said first mixture leaving an aqueous mineral phase containing a residual amount of said solvent; and recovering bitumen from the bitumen-rich solvent phase.

2. The method of claim 1 wherein said tar sands are at least partially consolidated and wherein prior to said mixing step said tar sands are ground to a particle size of no larger than about ½ inch.

3. The method of claim 2 wherein said at least partially consolidated tar sand is ground using a wet grinding technique.

4. The method of claim 3 wherein said wet grinding technique is selected from the group consisting of solvent wet grinding, water wet grinding and solvent/water wet grinding.

5. The method of claim 3 wherein said wet grinding is done in an autogeneous or semi-autogeneous mill.

6. The method of claim 1 additionally comprising the step of stripping residual solvent from said aqueous mineral phase.

7. The method of claim 6 additionally comprising the step of recovering water from the solvent stripped aqueous mineral phase.

8. The method of claim 1 additionally comprising the step of reducing the fines content of the bitumen-rich solvent phase.

9. The method of claim 8 wherein said step of reducing the fines content comprises the step of deasphaltening said bitumen-rich solvent phase prior to the recovery of the bitumen from said bitumen-rich solvent phase.

10. The method of claim 1 wherein said tar sands comprise oil wet tar sands.

11. The method of claim 1 wherein said mixing and separating steps are conducted at an operating temperature of about 110°–130° F.

12. The method of claim 11 wherein said operating temperature is about 120° F.

13. The method of claim 1 wherein said first mixture comprises an aqueous phase having a pH of no greater than about 9.

14. The method of claim 1 wherein said aqueous medium consists essentially of water.

15. The method of claim 1 wherein said displacing amount of said aqueous medium comprises about 0.22–0.27 pounds of water per pound of mineral.

16. The method of claim 1 wherein said organic solvent is added in an amount of about 2–5 parts solvent per part bitumen.

17. The method of claim 1 wherein said mixing conditions comprises a mixing power input of at least one horsepower per thousand gallons of said first mixture.

18. The method of claim 17 wherein said mixing conditions comprises a mixing power input of about 1–50 horsepower per thousand gallons of said first mixture.

19. A method of recovery of bitumen from tar sand, said tar sand being at least partially consolidated, said method comprising the steps of:

solvent/water wet grinding said tar sands;

mixing the ground tar sands, an organic solvent effective in solubilizing bitumen including asphaltenes from the mineral of said tar sands and a displacing amount of no more than about one void volume of an aqueous medium effective in displacing bitumen-rich solvent from said ground tar sands and in avoiding substantially spontaneous emulsion formation to form a first mixture, said mixing being at tar sands mixing conditions including mixing intensity and duration to suspend said tar sands and provide sufficient mass transfer between phases of said first mixture without significant emulsion formation, said first mixture being readily separable to a bitumen solution and a sand-water mixture upon cessation of said mixing;

separating a bitumen-rich solvent phase from said first mixture leaving an aqueous mineral phase containing a residual amount of said solvent;

stripping residual solvent from said aqueous mineral phase;

recovering water from said solvent stripped aqueous mineral phase;

removing fines from said bitumen-rich solvent phase; and recovering bitumen from said bitumen-rich solvent phase.

20. The method of claim 19 wherein said ground tar sands comprise tar sands ground to a particle size of no larger than about one-half inch.

21. The method of claim 19 wherein said tar sands comprise oil wet tar sands.

22. The method of claim 19 wherein said mixing and separating steps are conducted at an operating temperature of about 110°–130° F.

23. The method of claim 22 wherein said operating temperature is about 120° F.

24. The method of claim 19 wherein said aqueous medium consists essentially of water.

25. The method of claim 19 wherein said displacing amount of said aqueous medium comprises about 0.22–0.27 pounds of water per pound of mineral.

26. The method of claim 19 wherein said organic solvent is added in an amount of about 2–5 parts solvent per part bitumen.

27. The method of claim 19 wherein said mixing conditions comprises a mixing power input of at least one horsepower per thousand gallons of said first mixture.

28. The method of claim 27 wherein said mixing conditions comprises a mixing power input of about 1–50 horsepower per thousand gallons of said first mixture.

29. A method of recovery of bitumen from tar sand, said tar sand being at least partially consolidated oil wet tar sand from the Sunnyside deposit in Carbon County, Utah, said method comprising the steps of:

wet grinding said tar sands to a particle size of no larger than about one-half inch;

mixing said ground tar sands, an organic solvent effective in solubilizing bitumen including asphaltenes from the mineral of said tar sands and a displacing amount of no more than about one void volume of an aqueous medium effective in displacing bitumen-rich solvent from said ground tar sands and in avoiding substantially spontaneous emulsion formation to form a first mixture, said displacing amount of said aqueous medium comprising about 0.22–0.27 pounds of water per pound of mineral, said mixing being at tar sand mixing conditions including a mixing intensity of at least about one horsepower per thousand gallons of said mixture and a mixing duration of at least one minute to suspend said tar sands and provide sufficient mass transfer between phases of the mixture without significant emulsion formation, said first mixture being readily separable to a bitumen solution and a sand-water mixture upon cessation of said mixing;

separating a bitumen-rich solvent phase from said first mixture leaving an aqueous mineral phase containing a residual amount of said solvent;

stripping residual solvent from said aqueous mineral phase;

recovering water from said solvent stripped aqueous mineral phase;

reducing the fines contents of the bitumen-rich solvent phase; and recovering bitumen from said bitumen-rich solvent phase.

30. The method of claim 29 wherein said tar sand is ground using a grinding technique selected from the group consisting of solvent wet grinding, water wet grinding and solvent/water wet grinding.

31. The method of claim 30 wherein said grinding is conducted in an autogeneous or semi-autogeneous mill.

32. The method of claim 29 wherein said step of reducing the fines content comprises the step of deasphaltening said bitumen-rich solvent phase prior to the recovery of the bitumen from said bitumen-rich solvent phase.

33. The method of claim 29 wherein said first mixture comprises an aqueous phase having a pH of no greater than about 9.

34. The method of claim 29 wherein said aqueous medium consists essentially of water.

35. The method of claim 29 wherein said organic solvent is added in an amount of about 2–5 parts solvent per part bitumen.

* * * * *